US009307600B2

(12) United States Patent
Upton

(10) Patent No.: US 9,307,600 B2
(45) **Date of Patent: *Apr. 5, 2016**

(54) SYNCHRONIZED LIGHT SOURCE FOR ROLLING SHUTTER IMAGERS

(71) Applicant: RedBeard Ventures LLC, Solvang, CA (US)

(72) Inventor: Wayne A. Upton, Pasadena, CA (US)

(73) Assignee: RedBeard Ventures LLC, Solvang, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/729,436

(22) Filed: Jun. 3, 2015

(65) Prior Publication Data

US 2015/0271886 A1 Sep. 24, 2015

Related U.S. Application Data

(63) Continuation-in-part of application No. 14/085,597, filed on Nov. 20, 2013, now Pat. No. 9,060,404.

(60) Provisional application No. 61/728,397, filed on Nov. 20, 2012.

(51) Int. Cl.
*H05B 37/02* (2006.01)
*H05B 33/08* (2006.01)

(52) U.S. Cl.
CPC ..... *H05B 33/0845* (2013.01); *H05B 33/0842* (2013.01); *H05B 33/0809* (2013.01)

(58) Field of Classification Search
USPC ..... 315/291, 294, 307, 308; 348/135, 296, 348/302, 312, 324, 350
See application file for complete search history.

(56) References Cited

U.S. PATENT DOCUMENTS

| | | | | |
|---|---|---|---|---|
| 7,667,740 | B2 | 2/2010 | Hofer | |
| 8,218,068 | B2 | 7/2012 | Deever et al. | |
| 8,362,712 | B1 | 1/2013 | Lebens et al. | |
| 2007/0296354 | A1 | 12/2007 | Okabe | |
| 2012/0069176 | A1* | 3/2012 | Park | G01S 17/89 348/135 |
| 2012/0123213 | A1* | 5/2012 | Seto | A61B 1/0638 600/178 |

* cited by examiner

*Primary Examiner* — Douglas W Owens
*Assistant Examiner* — Thai Pham
(74) *Attorney, Agent, or Firm* — Myers Andras LLP; Joseph C. Andras

(57) ABSTRACT

A lighting system adapted for use with a rolling shutter imagers. The system uniquely provides synchronous operation of a light source in the context of an imager with a "rolling-shutter"-type exposure architecture. The preferred embodiment comprises a lamp such as a LED, a drive circuit coupled to the lamp capable of energizing the lamp for switching the lamp on and off, and a lamp control circuit coupled to the drive circuit with a means for receiving a timing signal from an imaging system, the lamp control circuit synchronously energizing the lamp with the timing signal via the drive circuit, the timing signal being a line timing signal for a PWM system based on a multiple of lines, a signal indicating a pause in the imager readout, or a signal indicating a portion of the imager readout time when the lamp may safely be flashed on without corrupting the desired active imager lines.

22 Claims, 4 Drawing Sheets

SYNCHRONIZED LIGHT SOURCE FOR ROLLING SHUTTER IMAGERS

RELATED APPLICATIONS

This application is a continuation-in-part of U.S. Non-Provisional patent application Ser. No. 14/085,597, filed Nov. 20, 2013, now pending, which claims the benefit of U.S. Provisional Patent Application Ser. No. 61/728,397, filed Nov. 20, 2012, both hereby incorporated by reference in their entirety as if fully set forth herein.

BACKGROUND OF THE INVENTION

1. Technical Field

This invention relates generally to the field of medical video equipment. More specifically, the invention comprises a synchronized light source for rolling shutter imagers, i.e. a control system for an LED light source for use with an endoscopic or similar camera system with a CMOS-type imager.

2. Description of the Related Art

There are many types of light sources and related control systems for endoscopic video. Many of these use a high-output lamp or incandescent bulb such as metal halide, quartz-halogen, or xenon types. These lamps are typically used in a mode of a fixed luminous intensity, and the intensity of light transmitted out of the device is controlled by means of a moving and variable mechanical aperture, an example being an iris, which blocks some or all of the light being generated by the lamp to the receiving fiber optic light guide.

Control of the intensity of this light is important for various functional and safety reasons. Improper light levels can cause under-exposure or over-exposure, forcing the camera system to overcompensate in ways that reduce or limit the image quality and camera performance. Safety concerns involving high light transmission can include skin and tissue burns, and possible ignition of flammable materials.

Adoption of high power Light-Emitting Diode (LED) technologies is becoming common in many fields and industries, including medical endoscopy, reducing overall power and cost while increasing product reliability and service life. LED light output intensity can be controlled by varying the amount of electrical current driving the LED device. This method has several drawbacks including inefficiency, a practical minimum for the lower end of light output, and a tendency for the color, or output wavelength(s), of the LED lamp to drift with intensity. Being a solid state device, it is also common practice to control overall LED light output in a switched Pulse-Width Modulation (PWM) fashion. For the human eye, film cameras, and some video cameras, this pulsed light is effectively integrated into an "average" that when applied at an appropriate frequency can be virtually indistinguishable from a constant light source. For human vision persistence, this frequency is typically about 30 pulses per second.

The PWM method of light intensity control works well with video cameras with frame-transfer imagers such as CCDs (Charge-Coupled Devices), so long as the switching frequency of the light is equal or greater than the camera's rate of frame capture, typically 60 exposures per second for a video camera. It is convenient to use an integer multiple of the frame rate, such as double, for the PWM switching frequency. It is also beneficial to synchronize the light source with the camera's frame rate to avoid a frequency mismatch with can result in a beating, flickering or "strobing" image.

However, with the recent adoption of CMOS (Complementary Metal Oxide Semiconductor) imagers into medical endoscopy, PWM-controlled LED light sources present a challenge. Specifically, the challenge relates to CMOS imagers with a "rolling-shutter"-type exposure architecture, the most common type, as these are not frame-transfer devices. Instead, each line of the raster image is exposed in a cascading overlapped sequence, with lines being read out while other lines are exposing. The exposure of one line will thusly never start and stop at the same time as another line, even though the resultant time duration is same, and their exposures will overlap one another in time.

Thus, traditional frame-rate based PWM control is unsuitable, as individual lines or groups of lines may have a significantly different light exposure than other lines, creating undesirable regions of differing exposure within the image. The number of different regions of exposure is equal to twice the relative PWM frequency, and the complementary size of the light and dark regions being directly proportional to the PWM duty cycle. A PWM system not synchronous to the imager frame rate would additionally cause a "roll" of this effect, where the output video would have these regions in different places of the current image frame than the subsequent image frame.

Rolling shutter imagers can control exposure via an internal shutter mechanism. This is done by setting control registers inside the imager that specify the number of line times, as denoted by an HSYNC signal, that the imager lines are exposing. The granularity of this exposure control is thusly in one-line increments, and can vary from exposing for a full frame duration to exposing for only one line duration. For a full frame exposure time, this is typically the total number of lines in the imager minus one, as a line typically cannot be exposed while it is being read out, and if the imager is operating at 60 frames per second, the exposure time would be approximately 1/60 of a second, or 16.67 msec. On the other hand, if the imager were to have 1000 imager lines, then the shortest exposure duration achievable by the imager shutter when imaging at a rate of 60 frames-per-second is 1/60/1000 of second, or 16.67 usec. This is a particularly significant limitation, as exposures of 1/100,000 of a second (10 usec), or shorter are often necessary in medical imaging situations if there is no further control of the brightness of the light source.

What is desired, therefore, are methods for variable pulse width and PWM control of an LED light source for use with CMOS imagers capable of producing imager exposures equivalent to times shorter than the typical readout time of one imager line that do not produce an undesirable exposure effect to the video image.

SUMMARY OF THE INVENTION

In a one aspect, the invention resides in a lighting system adapted for use with a rolling shutter imager having a horizontal line rate comprising: a lamp; a drive circuit coupled to the lamp capable of energizing the lamp for switching the lamp on and off; and a lamp control circuit coupled to the drive circuit with a means for receiving a line timing signal from an imaging system, the lamp control circuit synchronously energizing the lamp with the line timing signal via the drive circuit, the line timing signal being based upon the horizontal line rate of the imager.

In another aspect, the invention resides in an illumination control system for passing timing information to a lighting system from an imaging system utilizing a rolling shutter imager operating at a horizontal line rate, comprising: an electronic connector; and a digital electronic signal carried by the electronic connector wherein digital pulses are timed to be synchronous with the horizontal line rate of the imager.

In yet another aspect, the invention resides in an illumination control system for passing timing information to a lighting system from an imaging system utilizing a rolling shutter imager operating at a horizontal line rate and a pixel clock rate, comprising: an electronic connector; and a digital electronic signal carried by connector wherein the signal is a clock derived from the pixel clock rate, wherein the lighting system utilizes foreknowledge of the horizontal line rate timing of the imager to derive the horizontal line rate from the clock signal.

In yet another aspect, the invention resides in a lighting system, adapted for use with an imaging system utilizing a rolling shutter imager operating at a horizontal line rate and a frame rate, comprising: a lamp; a drive circuit coupled to the lamp capable of energizing the lamp for switching the lamp on and off; and a lamp control circuit coupled to the drive circuit with a means for receiving a line timing signal from the imaging system, the lamp control circuit energizing the lamp synchronously with the line timing signal via the drive circuit, the line timing signal being based upon the horizontal line rate of the imager, wherein the lamp control circuit outputs a pulse-width modulated (PWM) signal that causes the drive circuit to energize the lamp in a pulse-width modulated manner synchronous to the line timing signal, the period of the PWM signal being an integer multiple of the imager horizontal line period but being shorter than the frame period, and the PWM duty cycle being variable to control the amount of light output.

In yet another aspect, the invention resides in a lighting system, adapted for use with an imaging system utilizing a rolling shutter imager capable of being temporarily paused in its readout comprising: a lamp; a drive circuit coupled to the lamp capable of energizing the lamp for switching the lamp on and off; and a lamp control circuit coupled to the drive circuit with a means for receiving a timing signal from the imaging system, the lamp control circuit energizing the lamp in conjunction with the timing signal via the drive circuit, wherein the lamp control circuit outputs a lamp drive signal that causes the drive circuit to energize the lamp during a pause in the imager readout with the lamp being de-energized during the readout of the imager.

In yet another aspect, the invention resides in a lighting system, adapted for use with an imaging system utilizing a rolling shutter imager having a desired portion of lines of active pixel data and an undesired portion of lines comprising: a lamp; a drive circuit coupled to the lamp capable of energizing the lamp for switching the lamp on and off; and a lamp control circuit coupled to the drive circuit with a means for receiving a timing signal from the imaging system, the lamp control circuit energizing the lamp in conjunction with the timing signal via the drive circuit, wherein the lamp control circuit outputs a lamp drive signal that causes the drive circuit to energize the lamp during the readout of the undesired portion of imager with the lamp being de-energized during the readout of the desired portion of the imager.

The invention and its various embodiments can now be better understood by turning to the following detailed description of the preferred embodiments which are presented as illustrated examples of the invention defined in the claims. It is expressly understood that the invention as defined by the claims may be broader than the illustrated embodiments described below.

DETAILED DESCRIPTION OF THE PREFERRED EMBODIMENTS

Figure 1:
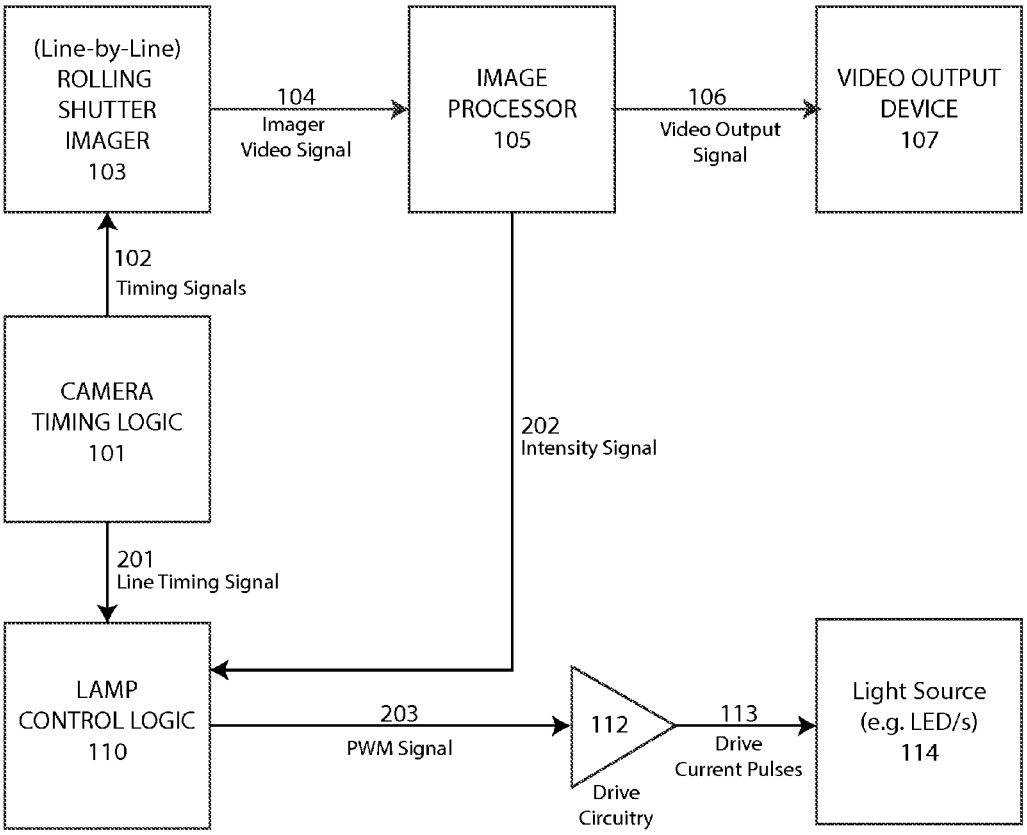
FIG. 1 is a block diagram of a presently preferred embodiment of the present invention.

FIG. 1 shows a block diagram of a presently preferred embodiment of the invention. The illustrated embodiment, and others, are based on the foundational observation that a "rolling shutter" imager can be said to have a "horizontal line rate" while operating, the rate at which entire horizontal lines of raster data are read out. Further, the imager has a "pixel clock rate", the rate at which each pixel within a line is individually read or "clocked" out from the sensor (imager), this pixel clock rate typically being hundreds to thousands of times faster than the line rate. The line rate is directly tied to the sensor's shutter mechanism, and therefore the exposure, as the amount of time exposure of a line is changed by increasing or decreasing the number of lines between when the line is read out, and when it is to start exposing again, or ceases being cleared.

As shown, the preferred embodiment relates to an endoscopic or similar video system that comprises a camera having a Rolling Shutter Imager 103 and a Light Source 114 that is pulsed on and off with a PWM signal 111 and associated drive circuitry 112 in order to strategically illuminate the subject matter that is focused onto the Rolling Shutter Imager 103. In the preferred embodiment, the Rolling Shutter Imager 103 is implemented with a CMOS imager. However, other imager technologies may use a rolling shutter approach to exposure. In addition, the preferred Light Source 114 is comprised of one or more LEDs, but the preferred and/or alternative embodiments may be implemented with any suitable light source that now exists or is later developed. It should be understood, therefore, that any reference to an LED is a reference to any suitable light source.

In more detail, Camera Timing Logic 101 provides timing signals 102 to the rolling shutter imager 103 (e.g. a CMOS Imager) which generates an Imager Video Signal 104. Image Processor 105 processes the Imager Video Signal 104, and generates a Video Output Signal 106 that drives a Video Output Device 107, and an Intensity Signal 109 that is fed back to the Lamp Control Logic 110, which indicates whether more or less light is desired from LED 114 in order to achieve a desired exposure. The Camera Timing Logic 101 also provides a Line Timing Signal 108, which is used by the Lamp Control Logic 101 to synchronize a PWM signal 111 to the Drive Circuitry 112, which in turn outputs the Drive Current Pulses 113 to the light source 114 (e.g. LED) in linear correlation to the PWM signal 111.

Figure 2:
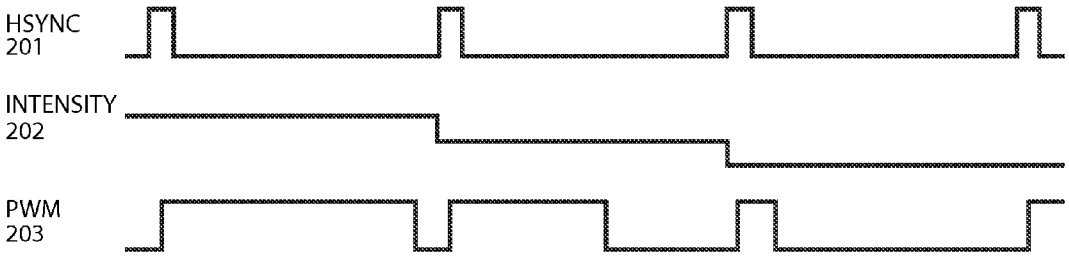
FIG. 2 is a timing diagram illustrating various timing relationships of the signals in the embodiment of FIG. 1 wherein the time of a single line readout is used as a time base for pulse-width modulation.

FIG. 2 shows a typical timing relationship of some signals of the preferred embodiment. A line timing signal 201 (e.g. HSYNC), generated by Camera Timing Logic 101 is applied to the Lamp Control logic 110 to generate the time-base and synchronicity of the drive current pulses 113. An Intensity Signal 202 is applied, which may be an analog signal (as shown) or a digital signal. This Intensity signal 202 is interpreted by the Lamp Control Logic 110 to determine the relative duty cycle or percent intensity. Finally, the Lamp Control Logic 110 outputs the PWM signal 203 which is used to drive the Light Source 113, e.g. to produce an LED emitter current with LED Drive Current Pulses, which has timing based upon the timing of HSYNC and a duty cycle based upon the Intensity Signal 202, wherein the more intensity indicated by the Intensity Signal 202, the longer the PWM signal 111 remains in the active, or current-driving state.

For more context, the preferred embodiment of FIGS. 1 and 2 may be implemented in the context of a medical imaging device: e.g. an endoscopic video camera with a CMOS imager having a rolling shutter; a light source using an LED for illumination of the scene to be imaged by said camera; LED drive circuitry, typically comprising transistors or similar current-switching devices; control circuitry with a means of controlling the average LED light output intensity using a PWM technique to control said LED drive circuitry, and a signal from the camera to the control circuitry that is synchronous to the rate of line readout of the CMOS imager. The control circuitry flashes the LED on and off at a rate based upon the line frequency of the CMOS imager exposure system, where one pulse (or plurality of pulses) happens per unit time elapsed while a line of the CMOS imager is read and restarts its exposure before moving on to the next line. For example, if a standard HD imager with 1920 horizontal pixels by 1080 vertical lines were to be exposed and read at 60 frames per second, the line frequency would be 1080 (number of lines per frame) times 60 (number of frames per second) which is equal to 64,800 lines per second, or approximately one line every 15.432 usec. A timing circuit would generate a pulse synchronous with this line rate of the CMOS imager, what would typically be called a digital horizontal sync pulse, commonly known as HSYNC. It should be noted that this HSYNC pulse is not typically the same as the HSYNC signal or timing element of the output video of the camera, as rolling shutter imagers typically are not, and in many cases cannot be, operated line-synchronously with conventional video transport standards, an example of which is the 1080p video format as outlined in SMPTE-274M. The control circuitry would receive this imager HSYNC digital pulse from the imaging system, typically by means of an electrical cable and electrical connectors, and use its frequency and position in time as the PWM time base. By means of the drive circuitry, the control circuitry a pulses the LED current at this frequency and position in time with the duty cycle of each drive pulse equivalent to the desired percent intensity desired from the LED, as determined by direct user input or calculated by camera processing. An illustration of one potential timing implementation can be found in FIG. 2.

As this line-based PWM system operates considerably faster than the frame-based PWM of conventional systems, an LED with appropriate on and off response times is required, along with drive circuitry capable of driving high LED currents at this rate with pulse widths of possibly very short duration. The ratio between the pulse widths of this line-based method versus the conventional frame-based method is approximated by the number of lines in the imager. For example, a 1% PWM pulse duration for a frame-based system operating at 60 frames per second would be 0.01×1/60=160 usec, assuming one pulse per frame, whereas the equivalent 1% PWM pulse duration for the line-based system described above would be 0.01×1/64,800=150 nsec, which is a 1:1080 ratio. As frame rates and sensor resolutions increase, specialty LEDs and drive circuitry may be required for desired results. Additionally, the drive circuitry of a this line-based system would typically consume more power and dissipate more heat as opposed to a frame-based system, as it has as to drive many more off-to-on and on-to-off transitions per frame, each of which will dissipate heat in the device as it switches in an analog fashion between states. For the above example, this would be 2×1080=2160 transitions per frame in this line-based system versus 2 or 4 transitions per frame in a frame-based system. For this reason, it would be advantageous to pulse the LED only once per line, instead a plurality of pulses per line, to keep the dissipated power, mechanical and electrical requirements, as well as cost, to a minimum.

Figure 3:
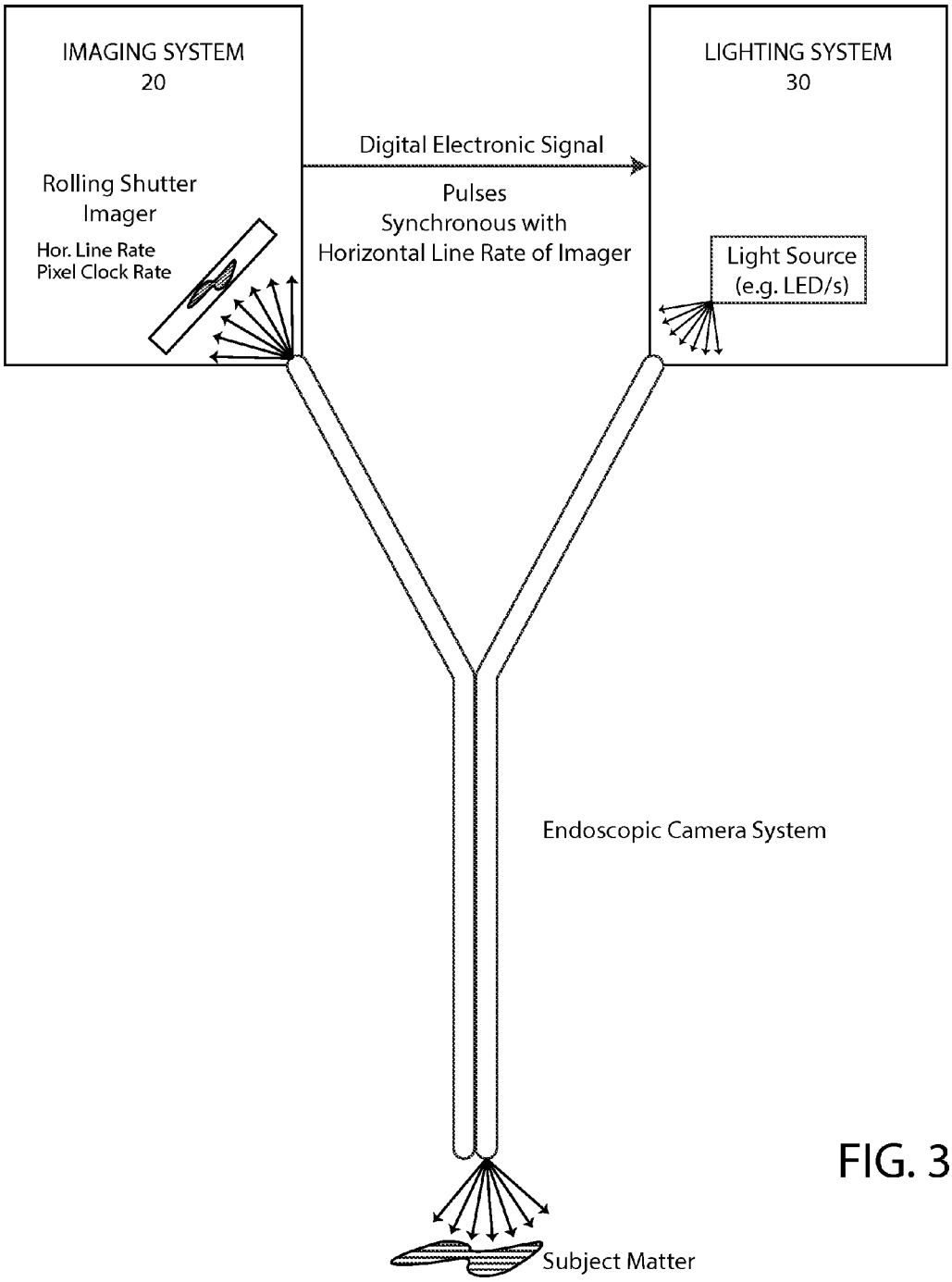
FIG. 3 is a block diagram of an illumination control system for passing timing information from an imaging system to a lighting system (that may or may not be integrated within a common housing or on a common circuit board), in the exemplary context of an endoscopic video camera system where the imaging system includes a rolling shutter imager operating at a horizontal line rate and where the lighting system receives a digital electronic signal having digital pulses that are synchronous with the horizontal line rate of the rolling shutter imager.

FIG. 3 represents a typical medical endoscopy situation where the Imaging System 20 and Lighting System 30 are separate units, though it should be noted that the two systems may be combined into the same enclosure. Between these two systems is an illumination control system that carries the horizontal line rate signal between the two systems. This would typically be physically implemented by an electrical connector present on both systems, and an electrical cable between. In this system, the signal passed between the systems is a digital pulse representation of the horizontal line rate of the imager in the imaging system. Based on this signal, the lighting system 30 synchronously energizes the related light source (e.g. LEDs or other lamps) with the horizontal line rate of the imaging system 20.

Figure 4:
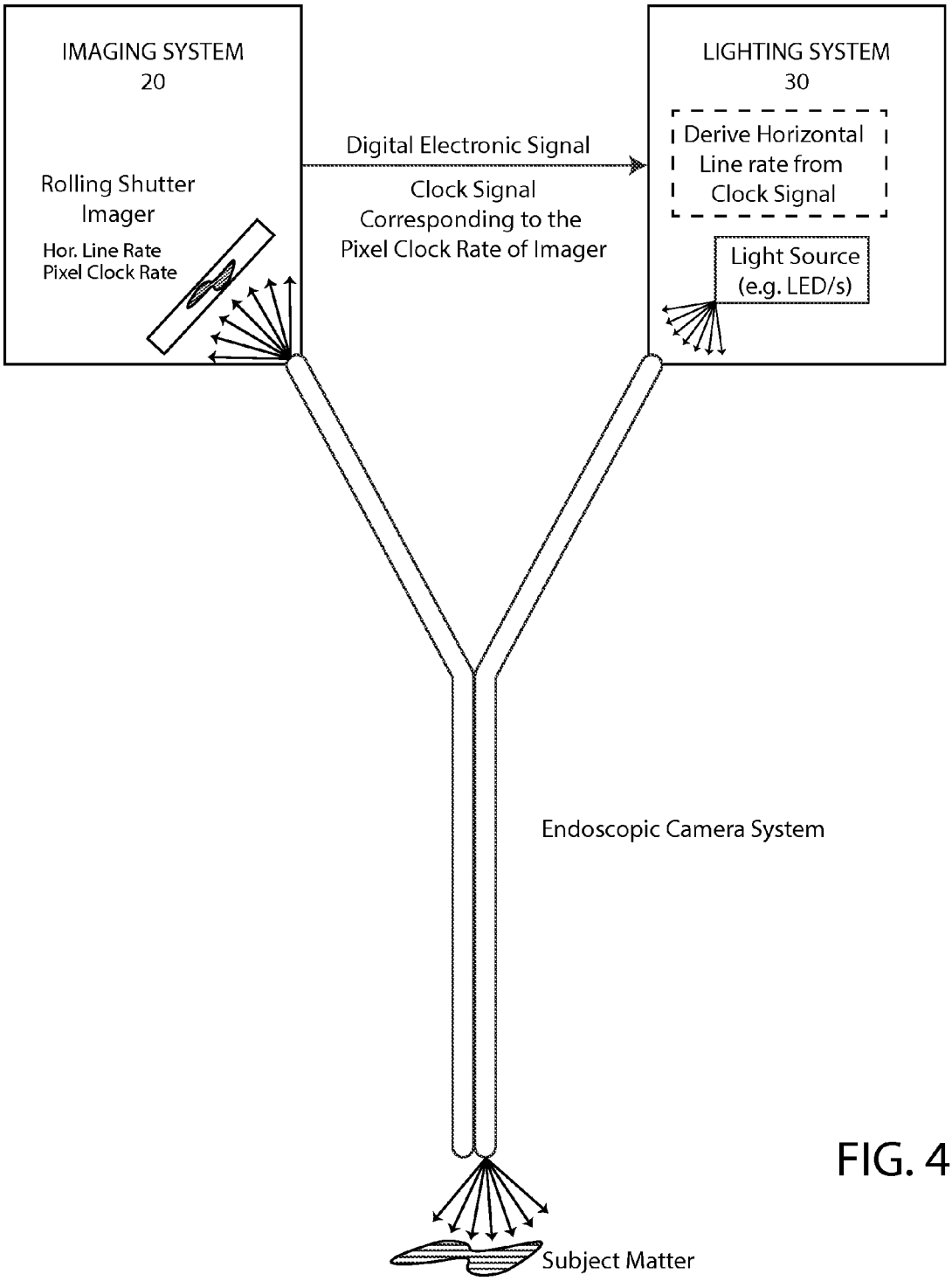
FIG. 4 is a block diagram of an illumination control system for passing timing information from an imaging system to a lighting system that is similar to FIG. 3, where the imaging system includes a rolling shutter imager operating at a horizontal line rate and, in more detail, at a pixel clock rate, and where the lighting system receives a digital electronic signal corresponding to a clock signal oscillating at the pixel clock rate and where the lighting system contains suitable processing capability to derive the horizontal line rate of the imager from the clock signal and other known parameters.

FIG. 4 represents a system very similar to one in FIG. 3, with the exception that the signal passed from the imaging system to the lighting system is a clock signal, based upon the pixel clock rate of the imager. As shown, the lighting system 30 includes a suitable means for deriving the horizontal line rate from the clock signal. In such case, the lighting system would require some foreknowledge of the timing of the imager and the imaging system, which could be programmed into the lighting system, or passed to the lighting system from the imaging system be means of another electrical interface, such as a serial communications port.

Another embodiment of the invention would be a generic form of the aforementioned system, wherein the signal from the camera to the control circuitry is the video output of the camera itself, and the control circuitry extracts the PWM time base from the line interval of the video signal, which may be of a video standard such as SMPTE 274M. This embodiment allows for a more generic interface between the camera and the control circuitry, such that the two devices may use standard interfaces to achieve the proper synchronization. This has the potential advantage of less specialized and dedicated interface, as it can be done without direct interface to the imager timing logic. This embodiment is advantageous when the light source and camera elements of the system are not contained in the same unit or enclosure. For best results this method requires the same time relationship between the imager line rate and the output video line rate. These may not always be the exactly the same duration or synchronicity in all implementations of video cameras, and therefore is not a universal solution. However, in the case where it is, this interface has the additional advantage of also carrying the picture level information, as it is the video itself, and therefore the lighting system would have the information required to adjust the brightness of the light automatically, should this be desired.

Another embodiment of the invention would be in the case where there is a duration of time where lines of the CMOS imager are not being read out, and all lines of the image are being exposed. This is a common practice in a multiple frame rate imaging system, such as one that operates at both 50 and 60 frames per second, dependent on the video standard of the country that the imaging system is being used in. For example, this duration where all lines are being exposed can be 16% of the total frame duration, but may also be longer or shorter by design. During these "idle" exposure times, the LED may continue to be pulsed at the same frequency that would otherwise correspond to the horizontal line frequency as if the lines were being read out at this rate. The LED may also be turned off or on entirely during this idle time. The LED may also be turned on for a portion of this time, either in a pulsed or constant fashion, for either a fixed or variable percentage of this idle time, which may or may not correspond to the duty cycle or frequency used during the non-idle period of the frame.

For example, a CMOS sensor for a typical 1080p (1920 pixels by 1080 lines, progressive scan) resolution camera application is the Panasonic MN34041, which has an active pixel array of 1944×1092 inside of a total pixel array of 2010×1108. Pixels in the total array that are not active may be optically black pixels (active pixels covered so as not be exposed to light, to establish a relative black level or noise floor), or "dummy" or ineffective pixels that have no useful data. The SMPTE 274 standard that defines 1080p video timing calls for a total of 1125 lines per frame, which includes 1080 active picture lines and 45 blanking lines. As the MN34041 has only a total of 1108 lines to be read out per frame, there is a deficit of 17 lines if the sensor lines are read out relatively synchronously to the output video timing. During this additional time of 17 output video lines, the sensor may be paused in readout in order to flash the lamp.

For some imagers, the camera readout may be paused in order to expose the imager such that no one line is being prohibited from exposure by the process of being read out. For other imagers there may never be a line that is not in read-out mode, and while in that mode it does not have the potential for exposing. For such imagers, the pause and the lamp flash may be timed to coincide with a predetermined line not desired for the output image. This predetermined line may be an active line that has been chosen for truncation, such as the top or bottom line of the image, an extra active line not used in the output image, a line of optical black, or a line of dummy pixels. The readout of some rolling shutter imagers may only be paused briefly, in which case this method may be utilized only when relatively short exposures are desired. For example, an imager may not allow for its readout to be paused for a singular duration of 17 output video lines. In this case, there may be multiple pauses during multiple line readouts, preferably optical black or dummy lines, in order to reduce the amount of pause for any one line. The lamp may be flashed on during any portion of any or all of these pauses in order to achieve the desired exposure.

In this embodiment, the imager shutter is set to expose lines for the full frame duration by the camera control logic. After the imager control logic reads out all lines from a frame, it then pauses readout briefly in order to flash the lamp on and off, creating a new exposure then proceeds to read out all lines in the frame from that exposure, starting the cycle anew. In a typical rolling-shutter imager, a line being read from the imager cannot simultaneously be exposed, so if the singular flash of the lamp were to occur when an active line were being read out, on the next output frame that line would not have been exposed, and it would be dark. As many camera applications use the extra active lines for features such as image stabilization, the most advantageous position for the lamp pulses are during only the optical black and dummy pixel line readout times.

The benefit of this embodiment is that exposure of the imager for durations of less than a typical line period (reciprocal of the line frequency) are achievable while utilizing a lamp drive circuit of the same speed as a previous frame-based PWM system. It also allows for exposure durations longer than a line (17 lines, for example) such that this embodiment may be utilized as a mode of imager and lamp operation for a greater percentage of time for smooth automatic exposure operation without forcing the imager control logic to change the imager shutter operation on a continual basis. Another benefit of this embodiment is that the motion distortion typical of rolling shutter imagers is eliminated, as all lines are exposed to light at the same time, as would be the case for a full-frame shutter imager such as a CCD. The tradeoff of this embodiment is that since has a limit for how long of an exposure is practical, achieving longer exposures in the same system would require using another method in conjunction with it. This may be another embodiment of this invention, or the use of longer imager shutter exposure times (relative to the pulse time of the lamp when using this embodiment) along with fixed lamp output.

Another embodiment closely related the previous embodiment takes further advantage of the fact that many imagers have more output lines than may desired to be displayed in the resultant image. For these imagers, the imager can be said to have two portions: a "desired" portion containing the lines actually used in the output image, and a surplus or "undesired" portion containing any remaining lines comprised of optical black pixels, dummy pixels, and any unused active pixels. In this embodiment, the time during readout of a line in the undesired portion may be used for flashing the lamp to expose the desired lines equally. Further, the entire undesired portion of the imager may be used for flashing the lamp, such that lamp flashing time can be across multiple unused line times. Further this can be an extension of the previous embodiment where the imager is paused during readout, such that the lamp may be energized during both the readout of undesired portion and any pause in readout. As in the previous embodiment, when the lamp is set to flash during the time when the imager is outputting the undesired portion of the pixel array, the imager shutter should be set to expose lines for the entire frame period, in other words, for all line times.

This embodiment is particularly useful when the imager cannot be paused for a significant amount of time, it is not desirable to pause the imager, and/or where the output of the imager may be frame-synchronized to the output video, but not necessarily line-synchronized. Like the previous embodiment, exposures for durations of less than a typical line period are achievable while utilizing a lamp drive circuit of the same speed as a frame-based PWM system, and motion distortion due to the rolling shutter is eliminated. This embodiment also allows for even longer exposure durations than the previous embodiment when used as a mode of imager and lamp operation for a greater percentage of time for smooth automatic exposure operation without forcing the imager control logic to change the imager shutter operation on a continual basis. This embodiment has the same tradeoff as the previous embodiment in that it requires the use of a second exposure mode, in this case to achieve longer exposure times than the time of the undesired portion readout.

Another embodiment of the invention would be the case where the lamp is modulated on and off on a line-by-line basis. In other words, the lamp would be turned on for single or multiple lines, alternating with being turned off for the subsequent line or multiple lines. The advantage of this type of system is that a slower, and therefore less expensive, drive circuit may be employed, as the pulses are longer by nature, or where the lamp itself cannot be turned on and off at the faster rates of the aforementioned embodiments. This further has the advantage of lower frequency radiated and conducted emissions created by the high power switching. However, the disadvantage of this type of line modulation is that to achieve completely uniform exposure across all lines or regions of the image, the time of the imager's total light exposure can only be increased or decreased by the factor of the number of lines on, plus the number of lines off. For example, if a power output of 75% is desired from the lamp, it may be flashed such that it is on for three lines, and off for one line. What follows is that the rolling shutter should be set such that the exposure time is in increments of four lines, to ensure that all lines receive a 3:1 ratio of lamp on-time to lamp off-time. Thus, the fewer lines to create the power ratio needed, the more increments of shutter are usable for a given number of horizontal imager lines. The larger the exposure increment is, the lower the number of possible exposure values, and therefore a coarser control of the exposure. This can be a disadvantage when smooth shutter operation is desired in an automatic exposure system. The minimum exposure increment is two lines, alternating one line on and on line off, to achieve a 50% light output from the lamp. Most sensors have an even number of horizontal image lines, but odd numbered increments of shutter exposure can be used if they divide evenly into the total number of imager lines. A 1080-line system is common for HD, and as the number 1080 has 3 and 5 as factors, these exposure increments would be feasible.

The following table illustrates the most practical ratios for this method, up to a 5-line exposure increment:

| Lines On | Lines Off | Average Lamp Power | Exposure Increment |
|---|---|---|---|
| 1 | 1 | 50% | 2 |
| 1 | 2 | 33% | 3 |
| 2 | 1 | 67% | 3 |
| 1 | 3 | 25% | 4 |
| 3 | 1 | 75% | 4 |
| 2 | 2 | 50% | 4 |
| 4 | 1 | 80% | 5 |
| 3 | 2 | 60% | 5 |
| 2 | 3 | 40% | 5 |
| 1 | 4 | 20% | 5 |

In the above table, the 2:2 line ratio is of note, as it yields the same lamp power result as the 1:1 line ratio, but it flashes the lamp at half the frequency. Thus, with the on and off times being slower, an even slower drive circuit or lamp could be utilized, at the cost of higher exposure increment.

Each of the above embodiments involving line-based PWM control of the lamp offer significant advantages over the prior art, however, they have either the disadvantage of requiring a very fast LED driver, or the disadvantage of a coarse shutter control that is complex, limited in flexibility, and suffering from not being visually "smooth" with regard to automatic brightness control. It is therefore desirable to employ a PWM system that can use both a slower LED driver and a varying PWM duty cycle for visual "smoothness".

An embodiment where this is achieved uses timing wherein the PWM period (reciprocal of frequency) is a multiple of horizontal line period (reciprocal of horizontal line rate), such as two, three, or more horizontal line periods. The PWM duty cycle is then applied normally across this entire multi-line PWM period. For optimal visual performance, the frame period (reciprocal of the frame rate) should be divisible by the PWM period. The imager r line exposure time can vary in this embodiment, but for optimal visual performance, the exposure time of the lines in the imager should be either the same as the PWM period, or an integer multiple of the PWM period.

Figure 5:
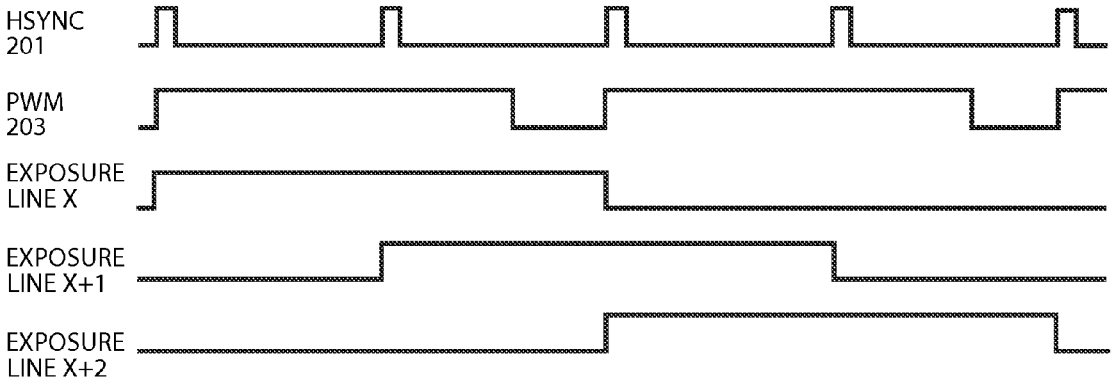
FIG. 5 is a timing diagram illustrating various timing relationships of the signals in the embodiment of FIG. 1 wherein the time of readout for multiple lines (in this case two) are used as the time base for pulse-width modulation.

For example, a system with 1080 lines could use a smooth 0-100% duty cycle on a PWM period of two horizontal line periods, and have functionally valid line exposure durations that are all multiples of two lines: 2, 4, 6, . . . 1076, 1078, 1080. FIG. 5 illustrates this example wherein the base of the PWM period is two horizontal line periods, shown in this example by the PWM (203) pulse occurring once for every two HYSNC (201) pulses. Three arbitrary sequential exposure shutter periods Exposure Line X, X+1 & X+2, also of two horizontal line periods in duration, are shown staggered and overlapped as typically occurs in rolling shutter imagers. Both Line X and Line X+2 are exposed to the light of a single PWM pulse, each of equal duty cycle. However Line X+1 receives light from a portion of the first PWM pulse, and also a portion of the second shown PWM pulse. As the shutter exposure time and the PWM period are the same, Line X+2 will be exposed to the same amount of light as Line X and Line X+1.

The advantage of this embodiment is that the PWM frequency can reduce from the horizontal line rate (~65 kHz in a 1080-line 60 frame-per-second system) to half the line rate (~32 kHz), to a quarter (~16 kHz), or considerably lower. These PWM lower frequencies result in longer PWM pulse widths while maintaining the same duty cycle, which allow slower LED drivers and LEDs with longer minimum switching times to be utilized, these being the practical limiting factors in these systems.

A mathematical comparison of this embodiment as opposed to a single-line based PWM illustrates the benefits. A typical 1080-line 60 frame-per-second imaging system has a horizontal line period of approximately 15 usec. A typical target exposure for an imaged frame might be 1/10,000 of a second, or 100 usec, and this translates to the amount of time the lamp is desired to be on assuming that the shutter is open (exposing) for the time the lamp is on or longer. For the one-line PWM based system of the previous embodiments, this 100 usec period would spread evenly across all 1080 line periods in the frame, and therefore each pulse of the LED would be 92.6 nsec, as the exposure of the imager to light is cumulative. Using the present embodiment, a two-line period timing would have half as many intervals, 960 instead of 1080, and thus the pulse would be twice as long (100 usec/960=185 nsec), and a three-line period timing would result in a pulse duration of 277 nsec. The advantage becomes clear with the example of 108-line period PWM timing, resulting in a pulse duration of 10 usec, 108 times longer than for a single-line PWM timing. At only one order of magnitude faster than a frame-based PWM system, an LED driver for a 108-line PWM timing is significantly more practical to implement than one required for a single-line PWM system (three orders of magnitude faster).

This embodiment allows for less expensive and less complex LED drive circuitry, slower LED lamps, and potentially lower conducted and radiated electromagnetic emissions. While a lowered PWM frequency does lower the granularity of line shutter control in the imager, the exposure-controlling aspect of the shutter is essentially replaced by the varying PWM duty cycle of the lamp, and visually "smooth" exposure changes are attained along with simplicity of control. Rolling shutter motion distortions can also be made less noticeable with this embodiment, as when the imager shutter is exposing for a relatively large number of lines and there are multiple PWM periods per line exposure time, motion in the captured image is effectively blurred such that distortion is less obvious to the observer, even when the lamp duty cycle is relatively low to effect short overall exposures.

Many other embodiments are possible without departing from the spirit and scope of the present invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

The invention claimed is:

1. A lighting system, adapted for use with an imaging system utilizing a rolling shutter imager operating at a horizontal line rate and a frame rate, comprising:

a lamp;

a drive circuit coupled to the lamp capable of energizing the lamp for switching the lamp on and off; and a lamp control circuit coupled to the drive circuit and receiving a line timing signal from the imaging system, the lamp control circuit energizing the lamp synchronously with the line timing signal via the drive circuit, the line timing signal being based upon the horizontal line rate of the imager, wherein the lamp control circuit outputs a pulse-width modulated (PWM) signal that causes the drive circuit to energize the lamp in a pulse-width modulated manner synchronous to the line timing signal, the period of the PWM signal being an integer multiple of the imager horizontal line period but being shorter than the frame period, and the PWM duty cycle being variable to control the amount of light output.

2. The lighting system of claim 1, wherein the frame period is divisible by the PWM period.

3. The lighting system of claim 1, wherein the line exposure time is equivalent to the PWM period.

4. The lighting system of claim 1, wherein the line exposure time is an integer multiple of the PWM period, but is shorter than the frame period.

5. The lighting system of claim 1, wherein the rolling shutter imager is a CMOS imaging sensor.

6. The lighting system of claim 1, wherein the lamp is a light emitting diode.

7. The lighting system of claim 1, wherein the imaging system and the lighting system are combined to comprise the same unit.

8. A lighting system, adapted for use with an imaging system utilizing a rolling shutter imager capable of being temporarily paused in its readout comprising:

a lamp;

a drive circuit coupled to the lamp capable of energizing the lamp for switching the lamp on and off; and a lamp control circuit coupled to the drive circuit and receiving a timing signal from the imaging system, the lamp control circuit energizing the lamp in conjunction with the timing signal via the drive circuit, wherein the lamp control circuit outputs a lamp drive signal that causes the drive circuit to energize the lamp during a pause in the imager readout with the lamp being de-energized during the readout of the imager.

9. The lighting system of claim 8, wherein the lamp drive signal has a varying duration in order to vary the amount of light output and the resultant imager exposure.

10. The lighting system of claim 8, wherein the shutter of the imager is set such that all active imager lines will expose during the pause of the imager readout.

11. The lighting system of claim 8, wherein the shutter of the imager is set to expose each imager line for the duration of the readout of all other imager lines.

12. The lighting system of claim 8, wherein the rolling shutter imager is a CMOS imaging sensor.

13. The lighting system of claim 8, wherein the lamp is a light emitting diode.

14. The lighting system of claim 8, wherein the imaging system and the lighting system are combined to comprise the same unit.

15. A lighting system, adapted for use with an imaging system utilizing a rolling shutter imager having a desired portion of lines of active pixel data and an undesired portion of lines comprising:

a lamp;

a drive circuit coupled to the lamp capable of energizing the lamp for switching the lamp on and off; and a lamp control circuit coupled to the drive circuit and receiving a timing signal from the imaging system, the lamp control circuit energizing the lamp in conjunction with the timing signal via the drive circuit, wherein the lamp control circuit outputs a lamp drive signal that causes the drive circuit to energize the lamp during the readout of the undesired portion of imager with the lamp being de-energized during the readout of the desired portion of the imager.

16. The lighting system of claim 15, wherein the lamp drive signal varies in duration in order to vary the amount of light output and the resultant imager exposure.

17. The lighting system of claim 15, wherein the lamp is energized during a portion or entirety of a pause in the imager readout.

18. The lighting system of claim 15, wherein the shutter of the imager is set such that all imager lines in the desired region will expose during the readout of the imager lines in the undesired portion.

19. The lighting system of claim 15, wherein the shutter of the imager is set to expose each imager line for the duration of the readout of all other imager lines.

20. The lighting system of claim 15, wherein the rolling shutter imager is a CMOS imaging sensor.

21. The lighting system of claim 15, wherein the lamp is a light emitting diode.

22. The lighting system of claim 15, wherein the imaging system and the lighting system are combined to comprise the same unit.

* * * * *